US005906534A

United States Patent [19]

Folkman et al.

[11] Patent Number: 5,906,534

[45] Date of Patent: May 25, 1999

[54] SHARPENING A KNIFE BLADE

[75] Inventors: Christopher V. Folkman, Oregon; Douglas M. Stapp, West Linn, both of Oreg.

[73] Assignee: Leatherman Tool Group, Inc., Portland, Oreg.

[21] Appl. No.: 09/006,850

[22] Filed: Jan. 14, 1998

[51] Int. Cl.[6] ..... B24B 1/00; B24B 7/19; B24B 7/30

[52] U.S. Cl. ..... 451/45; 451/57

[58] Field of Search ..... 451/28, 45, 57, 451/58, 191, 192, 196, 234, 321, 365, 556, 913, 65, 43, 44, 119, 132, 166, 193, 194, 203, 206, 195; 30/174, 174.1

[56] References Cited

U.S. PATENT DOCUMENTS 1,280,284 10/1918 Nickerson ..... 451/196
3,859,762 1/1975 Ludwig ..... 451/196
4,672,776 6/1987 McCullough ..... 451/143
5,390,445 2/1995 Giovanazzi et al. ..... 451/196
5,645,470 7/1997 Ludwig ..... 451/45

*Primary Examiner*—Timothy V. Eley
*Assistant Examiner*—Derris Holt Banks
*Attorney, Agent, or Firm*—Chernoff, Vilhauer, McClung & Stenzel, LLP

[57] ABSTRACT

A method and apparatus for grinding a knife blade to form a sharpened edge. The blade is held in a fixture including a self-centering clamp with a pair of jaws gripping the knife blade by engaging opposite sides of a part of the blade tapered toward an edge location, and holding the blade so that the intended edge location of the blade is in a desired location with respect to the fixture. This permits use of profiled grinding wheels of hard material mounted on a carriage under computer control to grind an edge bevel accurately on each side of the blade, forming a sharp edge.

13 Claims, 14 Drawing Sheets

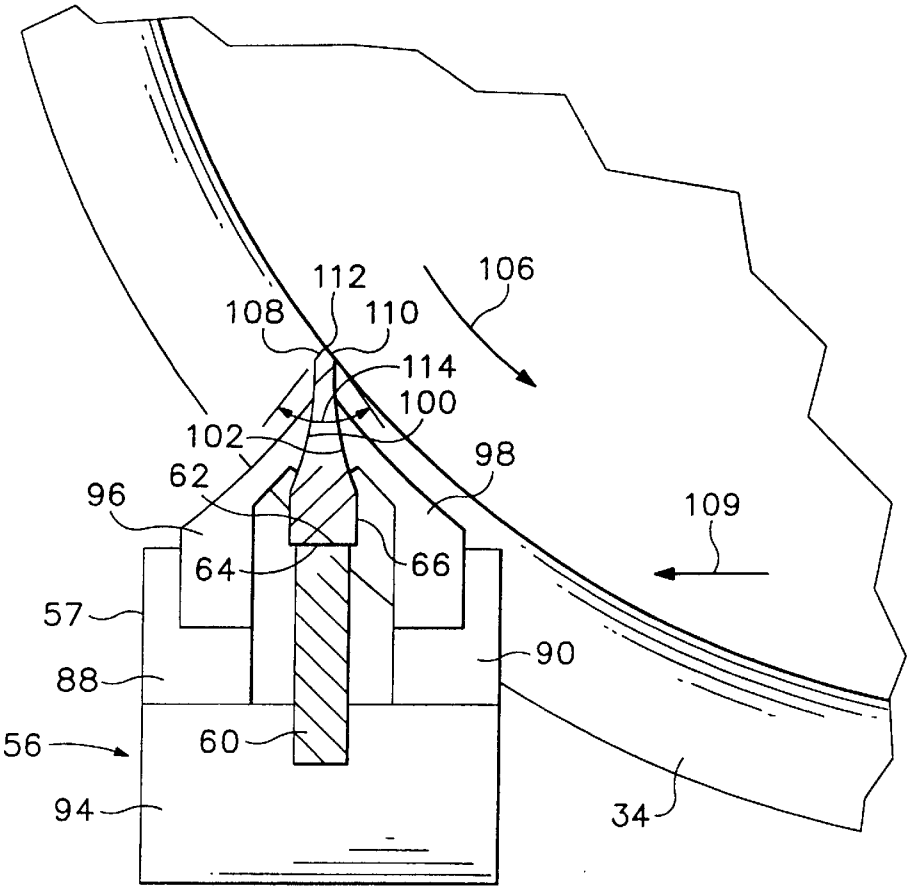
FIG.5
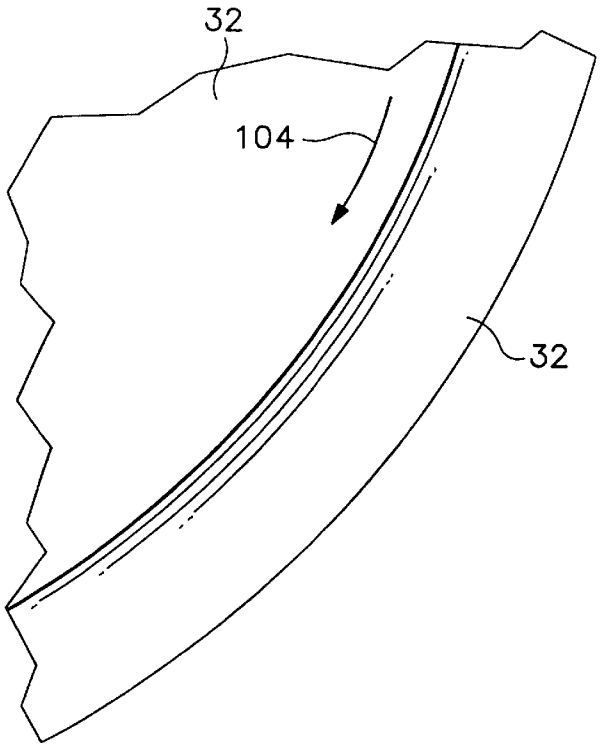

SHARPENING A KNIFE BLADE

BACKGROUND OF THE INVENTION

The present invention relates to manufacture of knife blades, and in particular relates to accurate mechanically-performed grinding of sharp edges on a series of similar knife blades.

In many knives the blade is tapered between its back and its edge by being beveled on both sides, either with a flat surface or hollow ground. It is desired in sharpening such a blade to provide a narrow edge bevel area on each side of the knife blade, ground at a somewhat steeper angle to provide the actual sharpened edge. It is desired for that narrow portion to conform closely to the profile of the blade, and for the two sides of the blade to be ground symmetrically. The edge bevel areas should be parallel with the entire knife profiles from the plunge to the tip of the blade to be cosmetically appealing.

Mass produced knife blades have slight dimensional variations resulting from the grinders used to produce the flat or hollow ground beveled side surfaces of such blades. In order to produce a desired sharp edge with symmetrical edge bevels on opposite sides of a knife whose blade has been beveled or hollow ground on both sides, it has therefore been necessary in the past for a person to hold each blade and to move the blade manually along a suitable abrasive wheel to sharpen knife blades by hand during the normal process of manufacture. That is, it has not been practical to use machines to automatically grind a final bevel surface to define a sharp edge with the necessary angle to produce a desired appearance, bevel width, and symmetry.

Some knife blade blanks intended to have serrations in an edge have been beveled flat or hollow-ground on each side to establish a tapered thickness of the blade, narrowing from the back of the blade toward the edge. The tang of such a tapered blade blank has then been clamped into a fixture, and a serrated portion of an edge has been ground into one beveled face using an abrasive wheel dressed to the shape required to provide the desired serrated edge profile. This method of holding a knife blade has not been found useful in sharpening entire knife blades during manufacture, however, because a knife blade cannot be located precisely enough by clamping the tang of the blade to form symmetrical edge bevels reliably on both sides of a blade without having to confirm or readjust the position of the blade between grinding steps. As a result, automatic sharpening of tapered knife blades has not been practical, and such blades have previously been costly because of the amount of skilled labor needed to finish the edge of each blade.

It is therefore desired to be able to grind both sides of a knife blade automatically to produce a symmetrically ground sharpened edge without having to readjust or check the blade's position in a fixture holding the blade during the process of grinding the edge.

SUMMARY OF THE INVENTION

The present invention provides a machine and a method for grinding sharp edges on a series of similar knife blades that have already been flat beveled or hollow ground on both sides toward a location for an edge portion from a maximum thickness near the back of the blade. Using the method and apparatus of the present invention, a pair of narrow symmetrical opposite side edge bevels can be ground on the knife blade automatically without having to adjust or reestablish the position of the knife blade once it has been properly established in a fixture.

In accordance with the present invention, a knife blade that has already been ground from an accurately made blank to establish an edge profile and to taper the blade's thickness is placed in a fixture including a clamp whose jaws are moved to contact the opposite sides of the tapered portion of the blade with clamping force, while other surfaces of the blade rest snugly against reference surfaces on the fixture. With the fixture located in a position between a pair of abrasive-surfaced grinding wheels, one grinding wheel is rotated in contact with the knife blade to form a first ground edge side bevel, and a grinding wheel is then brought in contact with the opposite side of the blade to form the second ground edge side bevel, thus defining a centrally-located sharp edge along the interaction of two symmetrically opposite ground edge side bevels, each formed by an appropriately shaped abrasive-surfaced grinding wheel rotating against the knife blade.

The method of the invention is preferably carried out automatically by the use of computer numerically controlled mechanisms which include servo systems to move a motor-driven spindle or spindles carrying the rotating abrasive-surfaced grinding wheel or wheels to predetermined locations with respect to the fixture carrying the blade.

The clamp arrangement utilized holds the tapered knife blade so that the desired location of the sharp edge of the blade is in a predetermined position, within suitably close tolerances, as the result of engagement of the opposite sides of the tapered knife blade by the jaws of the clamping mechanism of the fixture.

In a preferred embodiment of the invention, a pair of motor-driven spindles are mounted on carriages which are moved along a pair of parallel ways by a servo motor system under computer control, and a respective grinding wheel having a peripheral surface of a predetermined shape and covered by a coating of a durable abrasive material is carried into contact with each side of each knife blade in turn to form the respective ground edge side bevels thereon. Each grinding wheel is mounted on a spindle attached to a carriage through a mounting providing for precise adjustment of the orientation of the spindle about an axis preferably oriented normal to the axis of the spindle and a plane defined by the path of the spindle axis as the carriage is moved along the ways.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 5 is a schematic view similar to that of FIG. 4, showing a second side of the knife blade being ground to form a second ground edge side bevel and thus to form a sharp edge on the knife blade.

DETAILED DESCRIPTION OF THE PREFERRED EMBODIMENTS

Figure 1:
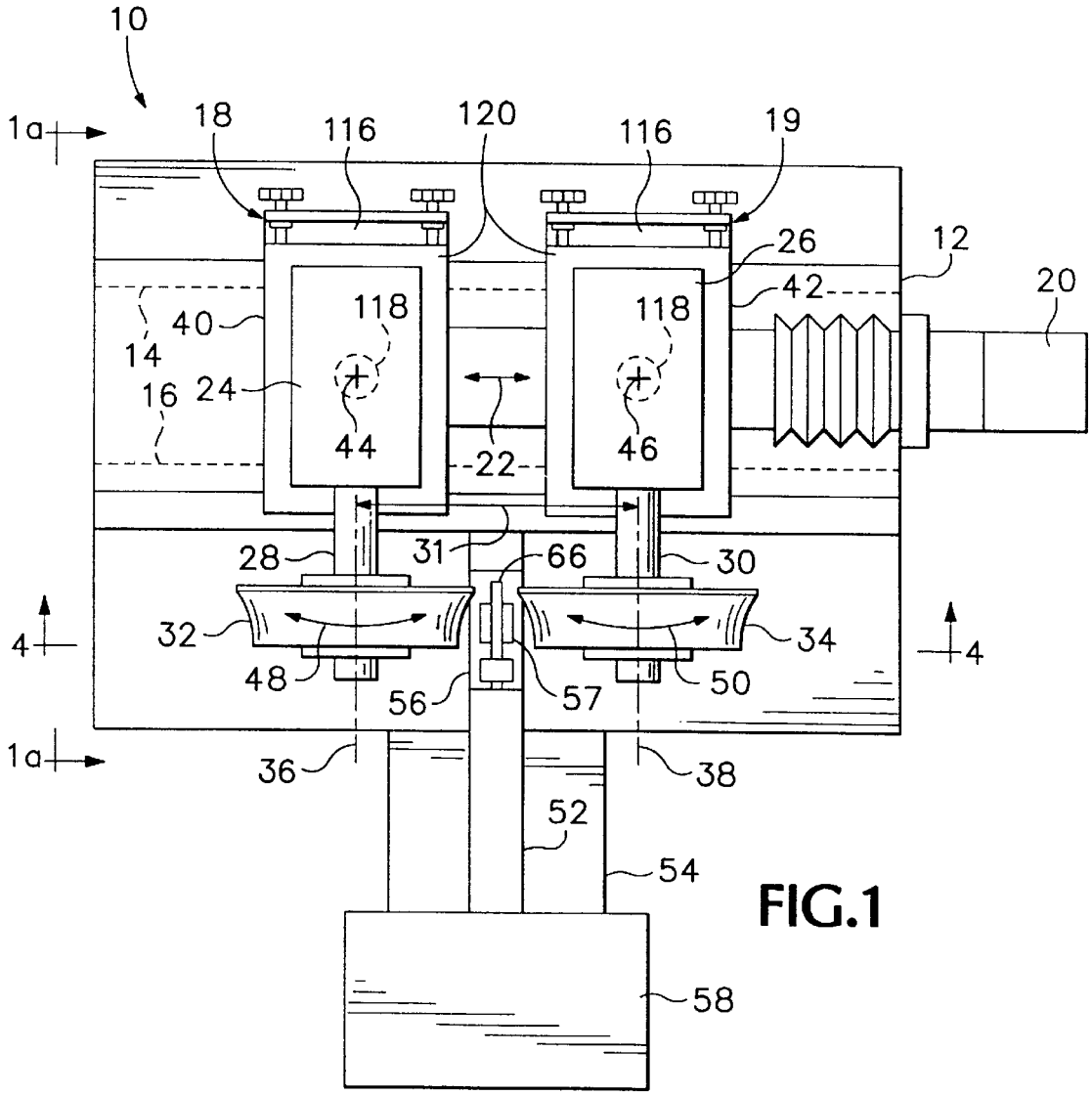
FIG. 1 is a simplified top plan view of a knife blade grinding machine embodying apparatus according to the present invention and useful in practicing the method thereof.
Figure 1A:
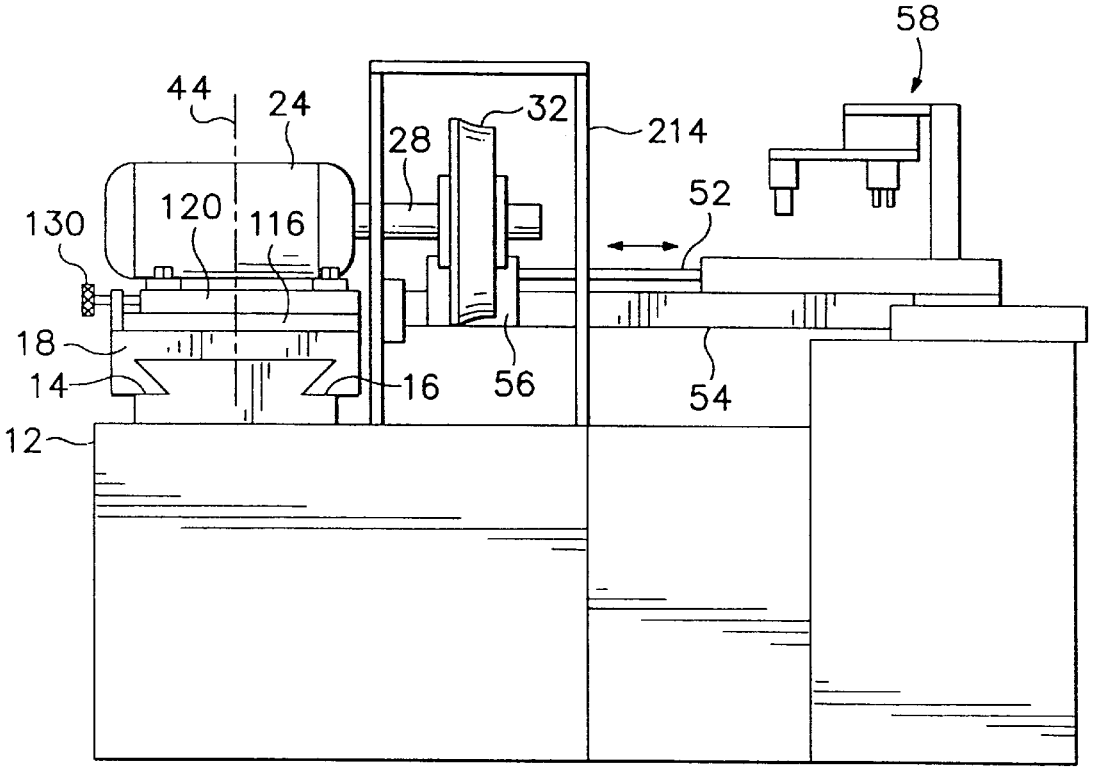
FIG. 1*a* is a simplified end view of the knife grinding machine shown in FIG. 1.

Referring now to the drawings which form a part of the disclosure herein, in FIGS. 1 and 1*a* a knife blade grinding machine 10 is seen to have a frame 12 supporting a pair of precisely machined ways 14 and 16 extending parallel with each other and generally horizontally. A pair of carriages 18 and 19 are mounted on the ways 14 and 16 for precise movement along them.

A suitable servo motor assembly 20 is mounted on the frame 12 and connected with the carriages 18 and 19 and is controlled by known servo control means including position sensors and a precise drive mechanism, such as a ball screw, in order to move the carriages 18 and 19 along the ways in the directions indicated by the arrow 22. Mounted on the carriages 18 and 19 are a pair of grinder motors 24 and 26 such as suitable electric motors including respective spindles 28 and 30. The carriages 18 and 19 are adjustably connected to the drive mechanism or each other, to establish a fixed distance 31 that remains constant between the spindles 28 and 30 during operation of the grinding machine 10. Profiled grinding wheels 32 and 34 are securely mounted on the spindles 28, 30 for rotation therewith about respective spindle axes 36, 38 which are preferably oriented horizontally and approximately normal to the direction of movement of the carriages 18 and 19 along the ways 14 and 16. The grinder motors 24 and 26 are preferably mounted on the carriages 18 and 19 so that the spindle axes 36 and 38 are both located at the same distances from the ways 14 and 16 and are substantially parallel with each other. Thus, as the carriages 18 and 19 move along the ways 14 and 16 the paths of the axes 36 and 38 define a single reference plane, and each of the ways 14 and 16 extends parallel with the reference plane in the directions of the arrow 22.

The grinder motors 24, 26, are attached to the carriages 18 and 19 through respective mounting assemblies 40, 42 which permit adjustment of the orientation of each spindle axis 36 or 38 through a small angle about a respective adjustment axis 44 or 46 extending normal to the reference plane. Some adjustment of the positions of the profiled grinding wheels 32 and 34 is thus provided, as indicated by the curved arrows 48 and 50, with respect to each other and with respect to the carriages 18 and 19.

Preferably, the grinding wheels 32 and 34 are coated with a durable layer of an abrasive material such as a cubic boron nitride material plated onto the grinding wheels in a small precisely controlled thickness. Because of the extreme hardness of the abrasive material the profile of such grinding wheels does not significantly change over the effective life of the wheel, and the wheels can be used to grind thousands of knife blades before replacement is required.

For example, a grinding wheel 32 or 34 which operates satisfactorily according to the present invention is a machined steel wheel manufactured by Wendt Dunnington, of Royersford, Pa., with a nominal grit size of $^{140}/_{170}$, with grit particles having a maximum dimension of approximately 150 microns. The grit is carried in a nickel plating whose thickness is approximately 0.0065 inch when using this size of abrasive grit.

A knife blade carrier 52 is supported by an auxiliary frame 54 in a location fixed with respect to the frame 12, as by being supported by and securely attached to the frame 12 of the grinding machine 10. The knife blade carrier 52 includes a blade holding fixture 56 preferably arranged to be moved automatically to and from a precisely established grinding position between the grinding wheels 32 and 34 by an appropriately controlled motor (such as a pneumatic cylinder and piston assembly) that is not part of the present invention, so that sharpened blades can be removed from the fixture 56 and unsharpened blades can be put into place to be sharpened when the fixture 56 is in a blade handling position (not shown). Preferably, an automatic feeding mechanism 58, shown only schematically, is included to feed partially completed knife blades serially to the fixture 56 and to remove each blade when it has been sharpened by the grinding machine 10.

Figure 3:
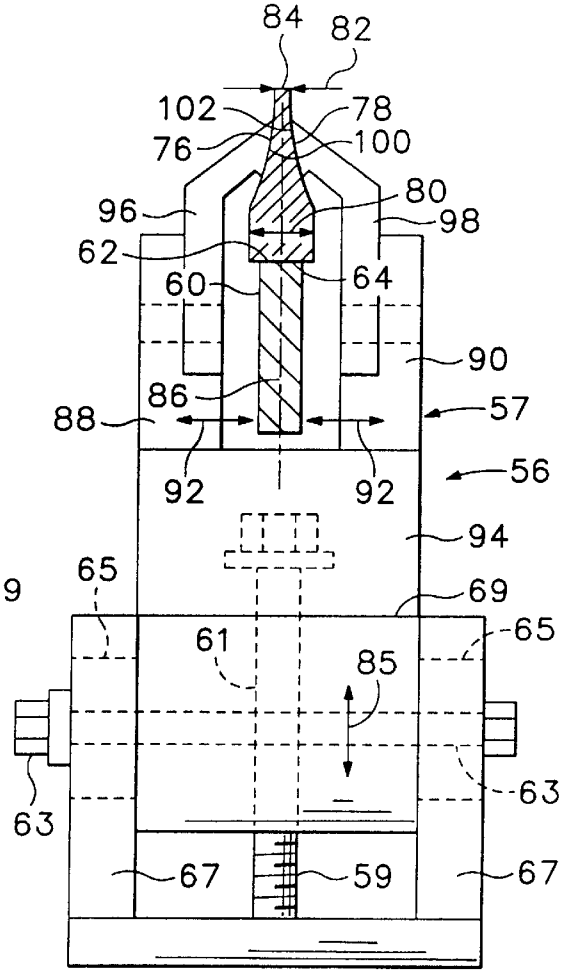
FIG. 3 is a section view of the blade-holding fixture shown in FIG. 2, taken along line 3—3.
Figure 2:
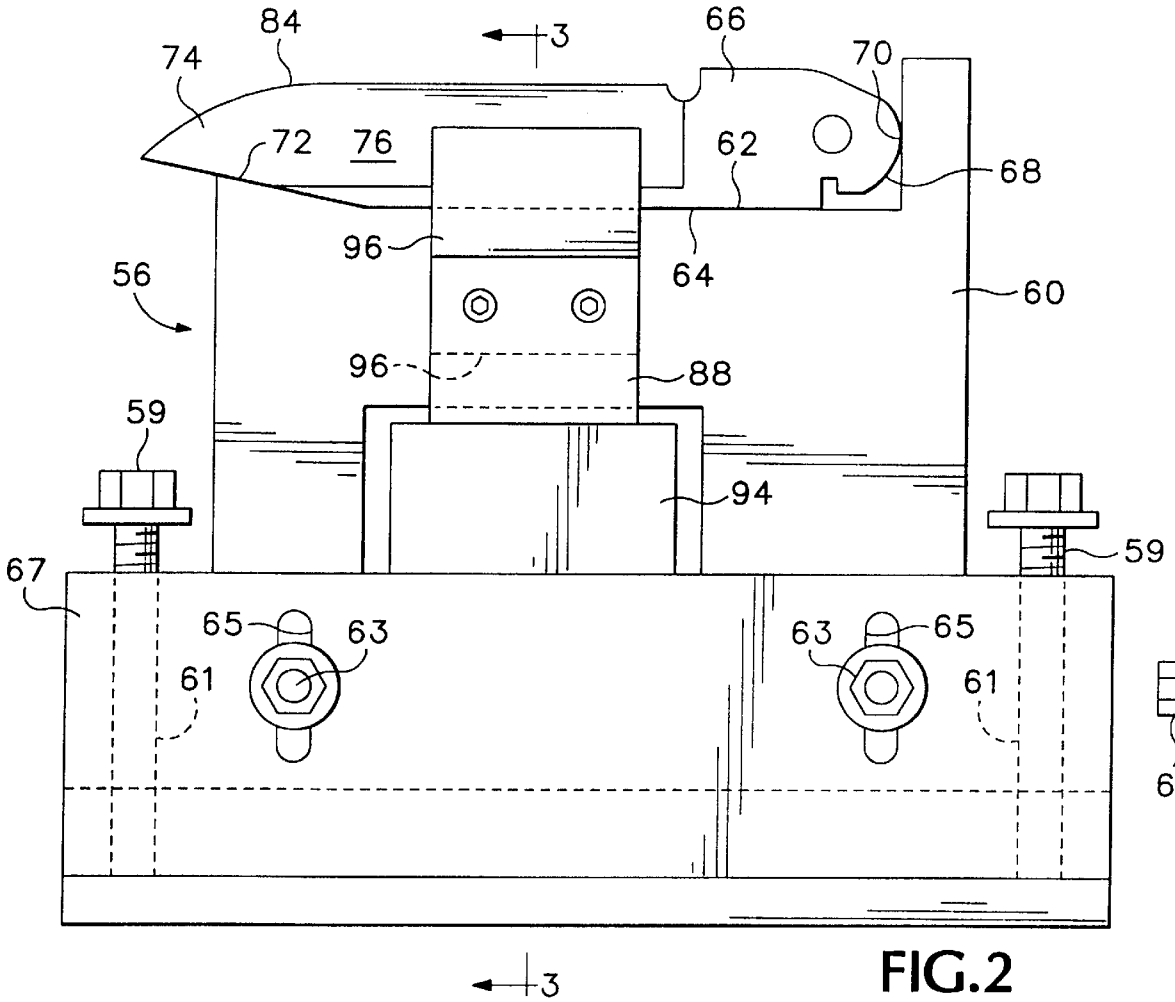
FIG. 2 is a side view of a blade holding fixture that is part of the apparatus shown in FIG. 1.

Referring next to FIGS. 2 and 3, the blade holding fixture 56 includes a self-centering, or parallel movement, clamp 57 and a carrier block 60 that includes a blade, back support surface 62 on which a back 64 of a partially completed knife blade 66 rests. The knife blade 66 shown in FIG. 2 is a blade for a folding knife and therefore includes a cam 68 at its rear end, while a blade for a non-folding knife might include a tang of greater length that would require a carrier block of a different configuration. The carrier block 60 includes an upright rear end locating surface 70 against which the cam 68 rests when the knife blade 66 is properly in place and ready to be ground to form a sharp edge, locating the blade 66 properly on the fixture 56 in a longitudinal direction. Additionally, an upwardly inclined tip end support portion 72 of the back support surface 62 of the carrier block 60 is shaped appropriately to support the back of the tip portion 74 of the knife blade 66.

The knife blade 66 is formed from a blank fashioned precisely, as by fine blanking the knife blade blank with a desired profile from a sheet of metal of the appropriate thickness, for the method of the invention to provide the best results. Thereafter, prior to sharpening the blade 66, its left and right sides are ground to form faces 76 and 78 and thus taper the knife blade 66, from a maximum thickness 80 near the back 64, to a predetermined minimum thickness 82 along an unsharpened edge portion or margin 84 where the sharp edge of the knife blade 66 is to be formed. The sides of a knife blade may be ground symmetrically by automatic machines to form flat beveled faces or, as is shown in FIG. 3, hollow ground and thus slightly concave faces 76 and 78. In either case, the self-centering clamp 57 holds the blade 66 so that the unsharpened margin 84 is located aligned with a central plane 86 of the carrier block and of the self-centering clamp 57 which is part of the knife blade carrier 52.

The height at which the blade holding fixture 56 holds a blade 66 with respect to the grinding wheels 32 and 34 is adjustable, as indicated by arrow 85, by means of, for example, a pair of adjustment bolts 59 fitted in and extending through threaded bores 61 in a movable portion 69 on which the clamp 57 and the carrier block 60 are carried. The required height is maintained by tightening clamping bolts 63 extending transversely through the movable portion 69 and through slots 65 defined in parallel vertical plates 67 of the fixture 56.

The self-centering clamp 57 that is a part of the blade holding fixture 56 includes a pair of opposite clamp arms 88 and 90 which are moved simultaneously toward or away from each other as indicated by the arrows 92 in FIG. 3. The arms 88 and 90 are thus kept equidistant from the central plane 86 by their interrelation with each other and with a base portion 94 of the clamp 57. Such a clamp may have its arms 88 and 90 each pivoted on a respective one of a pair of parallel axes and arranged to be moved by suitable cams on a rock shaft as shown in greater detail in FIGS. 11–15.

A pair of clamp jaws 96 and 98 are mounted, respectively, on clamp arms 88 and 90 and include respective clamping faces 100 and 102, each shaped to conform closely to one of the side surfaces 76 or 78 of the knife blade 66, in order to hold the knife blade 66 securely in the required position aligned with the central plane 86, with its cam 68 resting against the rear end locating surface 70, its back 64 supported on the back support 62 and its tip 74 supported on the tip support 72 portion of the carrier block 60, whose location is fixed with respect to the base 94 of the clamp. In turn, the carrier block 60 is mounted in a precisely determined location on a movable portion of the knife blade carrier 52. Accordingly, when the clamp 57 is operated to engage the opposite side surfaces 76 and 78 of the knife blade 66, the unsharpened edge portion 84 is aligned with the central plane 86 with acceptable precision, desirably within ±0.002 inch from the location of the central plane 86.

Figure 4:
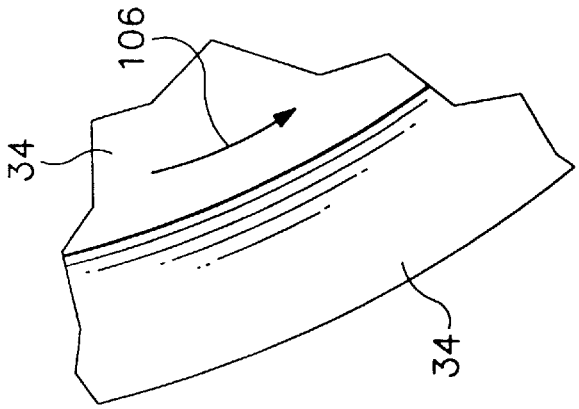
FIG. 4 is a schematic view taken in the direction of FIG. 3, showing a first side of a knife blade being ground to form a ground edge side bevel
Figure 4:
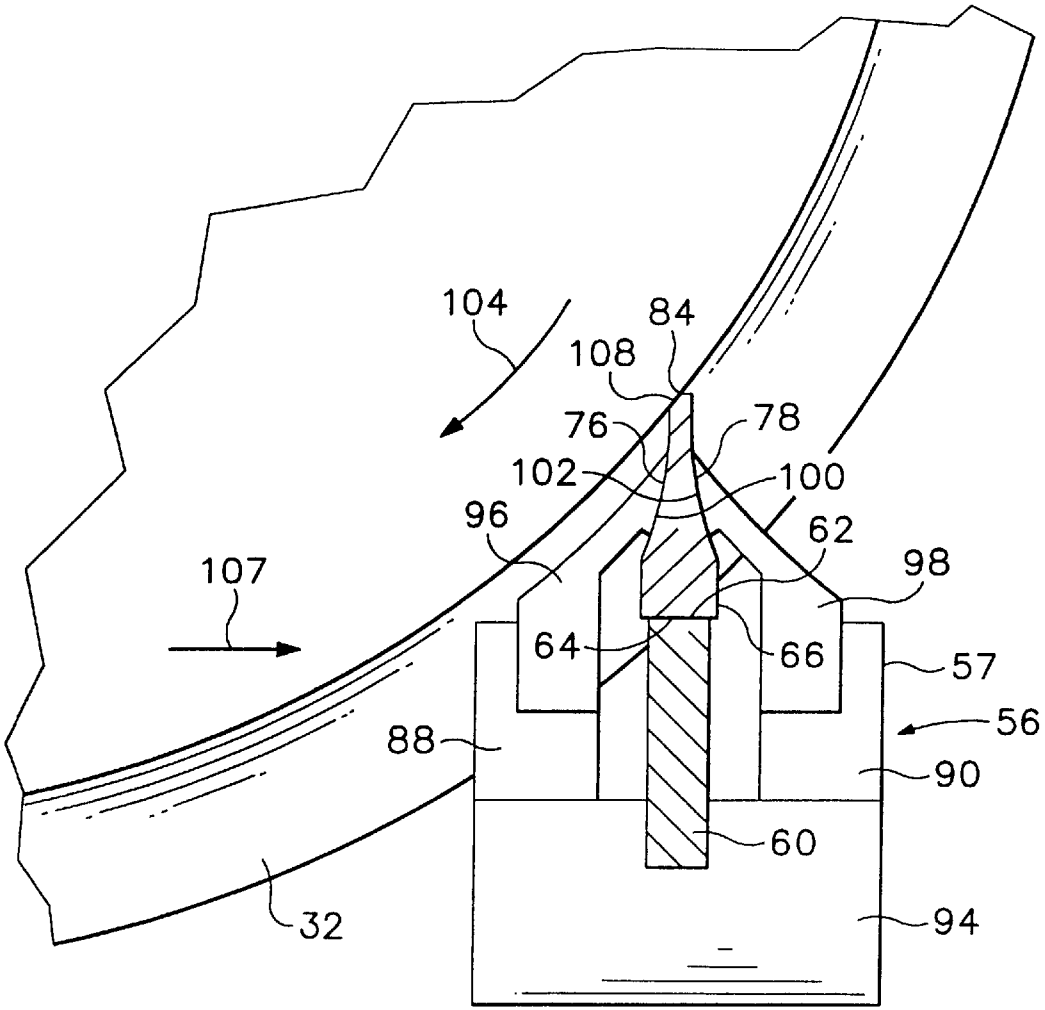

Referring also to FIGS. 4 and 5, once the knife blade 66 is held securely in the clamp 57, the knife blade carrier 52 is operated as necessary to place the holding fixture 56 in its grinding position between the lower portions of the grinding wheels 32 and 34, as shown in FIG. 1 in top plan view. The servo motor 20 is then operated, preferably under computer control, to move the carriages 18 and 19 along the ways 14 and 16 to bring first one and then the other of the grinding wheels 32 and 34 into contact with the knife blade 66. The spindles 28 and 30 are driven by the respective grinder motors 24 and 26 to rotate the grinding wheels 32 and 34 so that they rotate in the directions indicated by the arrows 104 and 106, thus bringing the moving abrasive surface of each of the grinding wheels 32 and 34 into contact with the respective side surfaces 76 or 78 along the unsharpened edge portion 84 of the blade 66. The abrasive surfaces remove material from the unsharpened edge portion 84 of the blade and carry removed particles of material downward toward the back 64 of the blade 66.

The servo motor 20 is operated to move the carriages 18 and 19 in the direction of the arrow 107 to a position calculated to bring the grinding wheel 32 into contact with the unsharpened edge portion 84 and the side surface 76 and then to continue to move the carriages 18 and 19 further in that direction to grind away enough of the material of the blade 66 to provide a desired edge profile and a first ground edge side bevel 108 aligned with the original position of the unsharpened edge 84. Thereafter, the servo motor 20 is operated to move the carriages 18 and 19 in the opposite direction, as indicated by the arrow 109, to bring the abrasive surface of the grinding wheel 34 into contact with the remaining portion of the unsharpened edge surface 84 and the opposite side surface 78 of the blade 66 and to move the carriage 18 and 19 a sufficient additional distance to remove material to leave the second side edge bevel 110.

The knife blade 66 is located lower than the spindle axes 36 and 38 by the required distance to produce the preferred angle of the bevel surfaces 108, 110 relative to the central plane 86. Since the size of the grinding wheels 32 and 34 remains substantially constant throughout its useful lifetime, the placement of successive knife blades 66 need not change to produce the desired bevel angle. As a result, the blade holding fixture 56 need not be able to pivot about a horizontal longitudinal axis, yet a sharpened edge 112 is formed with an internal angle 114 of the desired size between the first side and second side edge bevel surfaces 108 and 110.

Since the circumferential surfaces of the grinding wheels 32 and 34 are shaped to correspond with the edge profile of the blade 66, the first and second side edge bevel surfaces 108 and 110 are narrow, of equal width and symmetrically opposite each other between the side surfaces 76 and 78 of the blade and the resulting sharp edge 112. Each blade located on the fixture 56 is held by the clamp 57 in a position closely aligned with the central plane 86, and the sharpening operation can be carried out rapidly for many like blades once the grinding machine 10 has initially been adjusted and fitted with the necessary grinding wheels 32 and 34 for a certain knife.

Since the use of the self-centering clamp 57 assures that the unsharpened edge surface 84 is located in substantially the same position for each blade 66 placed in the fixture 56, the servo motor 20 can be controlled by a computer numerical control system to move the carriages 18 and 19 to grind away the required amounts of material from each side of the knife blades 66 to provide the first and second edge bevel surfaces 108 and 110.

Each of the grinding wheels 32 and 34 is manufactured in the precise size and surface configuration required for sharpening the blades 66 as described above. For the operation described to be able to grind both sides of the knife blade 66 to provide the sharpened edge 112 successfully, however, the spindles 28 and 30 must be aligned so that their axes 36 and 38 are properly located with respect to each other and so that the grinding wheels 32 and 34 are properly aligned with each other and with the position of the central plane 86 when each of the abrasive wheels 32 and 34 is grinding the knife blade 66. The positions of the grinding wheels 32 and 34 along the spindles 28 and 30 can be adjusted by suitable shims. Additionally, as previously mentioned, the position of each of the spindles 28 and 30 is adjustable through a small angle about a respective axis 44 or 46 which extends generally vertically in the grinding machine 10 shown in FIG. 1. Axes 44 and 46 thus extend normal to the respective spindle axis 36 or 38 and parallel with the central plane 86, which extends in and parallel with the narrow edge portion 84.

Figure 6:
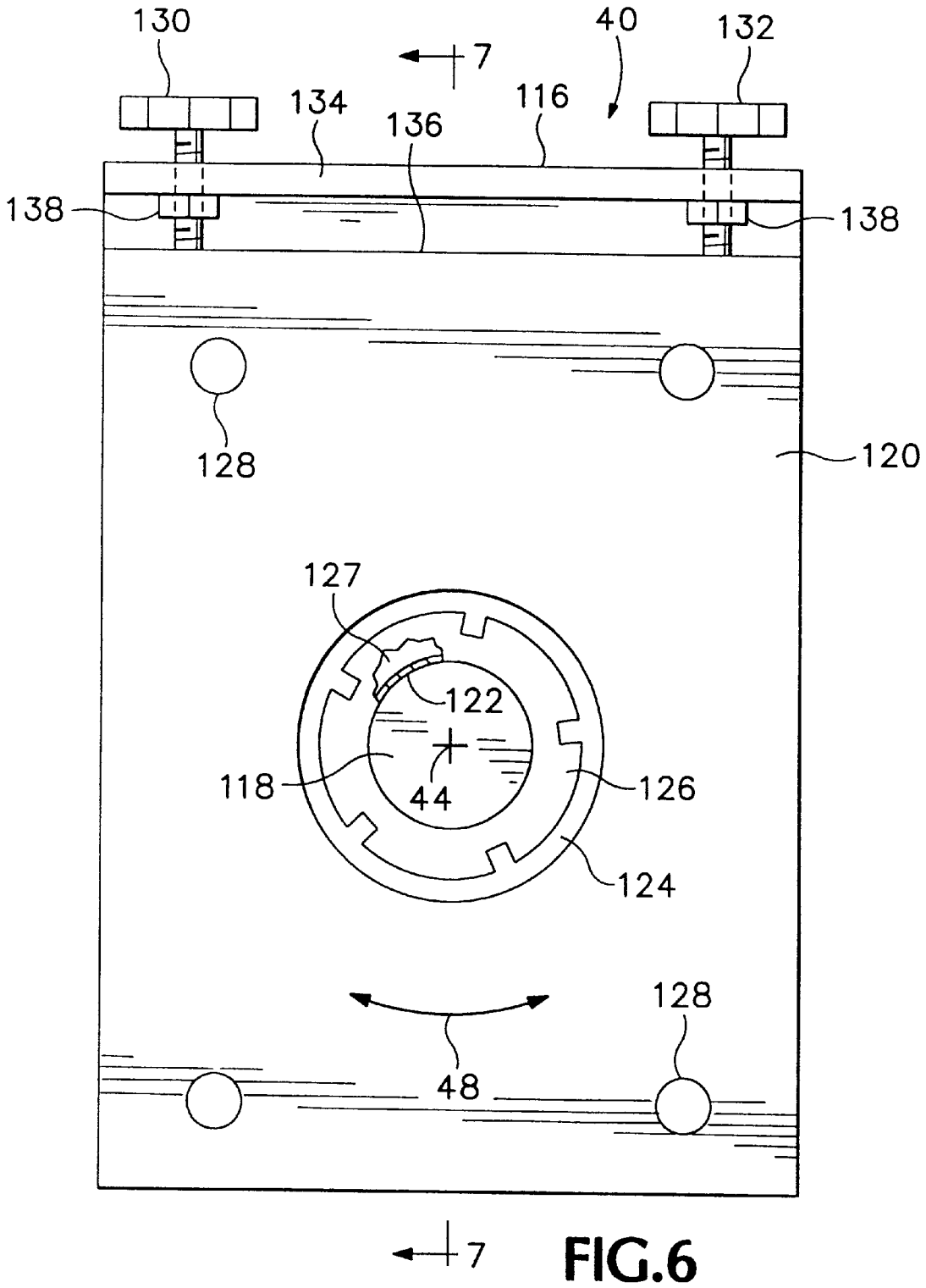
FIG. 6 is a top plan view of an adjustable mounting device for supporting a grinder included in the grinding machine shown in FIG. 1.
Figure 7:
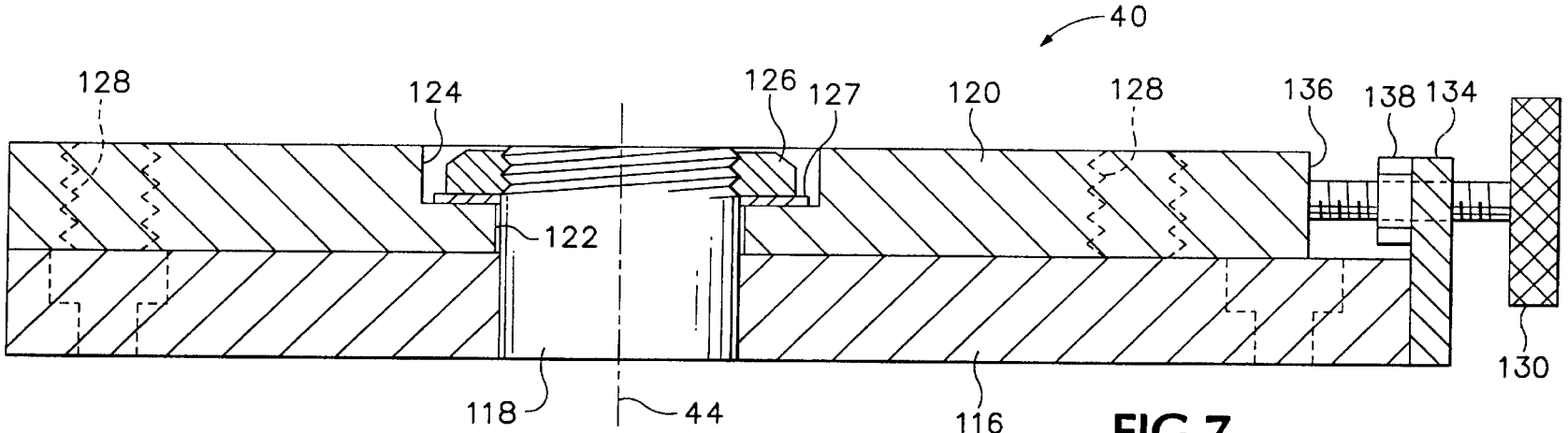
FIG. 7 is a section view of the mounting device shown in FIG. 6*e* taken along line 7—7.

As shown in FIGS. 6 and 7, the mounting assembly 40, to which the mounting 42 is substantially similar, includes a lower plate 116 that is mounted in a fixed position atop the carriage 18. A center post 118 is permanently fixed on the lower plate 116 and extends upward therefrom. An upper plate 120 rests atop the lower plate 116 and in sliding contact with it. The upper plate 120 defines a center hole 122 which fits movably but snugly about the center post 118. A circular recess 124 is provided in the upper portion of the upper plate 120, above the center hole 122, and a notched spanner nut 126 is attached to the center post 118 by mating threads and can be tightened to hold the upper plate 120 snugly in place atop the lower plate 116. A thrust bearing 127 is located between the spanner nut 126 and the surface of the upper plate 120 defining the bottom of the recess 124.

Mounting holes 128 are defined in the upper plate 120 and preferably include internal threads to receive hold down bolts to attach the grinder motors 24 and 26 to the mountings 40 and 42. The grinder motors 24 and 26 are preferably mounted so that the spindles 28 and 30 are in the same horizontal plane in the grinding machine 10. With the grinder motor 24 or 26 attached to an upper plate 120, the position of the spindle 28 or 30 can be adjusted to bring the abrasive wheel 32 or 34 into the required orientation to grind a blade 66, by use of adjustment screws 130 and 132 each engaged in a respective threaded hole through an upright flange 134 extending upward from the lower plate 116. Each of the adjustment screws 130 and 132 bears against a surface of the rear face 136 of the upper plate 120, so that backing out one and extending the other of the adjustment screws 130 and 132 will cause the upper plate 120 to rotate about the center post 118, thus moving the spindle 28 or 30 of the associated grinder motor 24 or 26 about the adjustment axis 44 or 46. Lock nuts 138 can be used to secure the adjustment screws 130 and 132 to hold the upper plate 120 in the required position. Other mechanical arrangements could be used instead, so long as they provide for precise adjustment of the orientation of the spindles 28 and 30 about the respective axis 44 or 46.

Because the diameters of the grinding wheels 32 and 34 do not change significantly through the lifetime of the abrasive surface, it is unnecessary to change the speed of rotation of the grinder spindles 28 and 30 to maintain a constant linear surface speed of the abrasive surface, and it is not necessary to change the height of the knife blade carrying fixture 56 with respect to the spindle axes 36 and 38 to maintain the proper angle of the edge bevel surfaces 108 and 110.

For sharpening knife blades an abrasive wheel 32 with a 12 inch outside diameter is preferably rotated at about a speed of slightly less than 3500 rpm, to provide a surface linear speed of about 10,900 surface feet per minute. During actual grinding, the surfaces of the knife blade 66 and the grinding abrasive wheel 32 are cooled by a flow of a liquid coolant, as is well known in the art of grinding metal. A suitable coolant is a water-based semi-synthetic coolant such as a product available from Associated Chemists, Inc. of Portland, Oreg. as its product number 4920.

ALTERNATIVE EMBODIMENT

Figure 8:
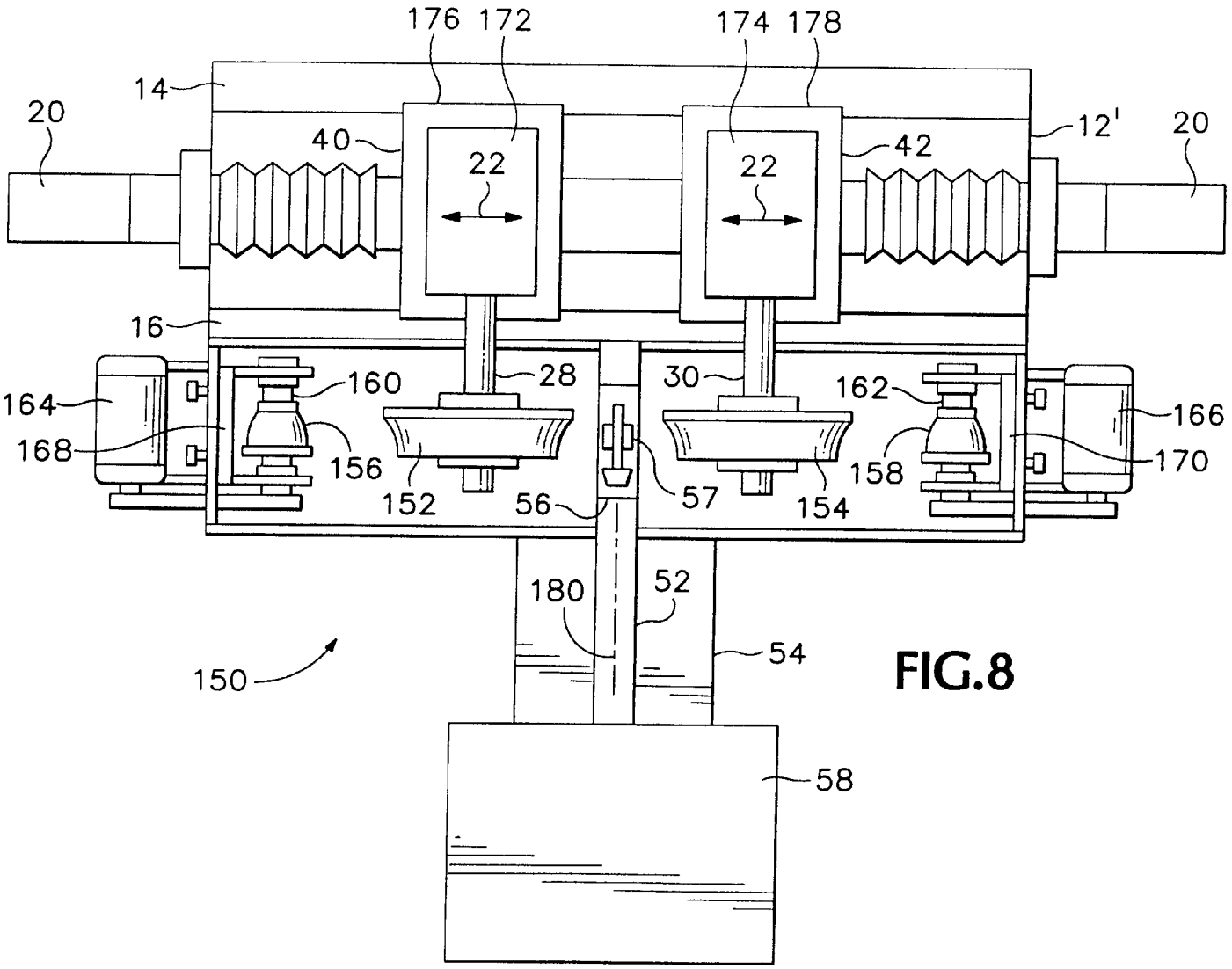
FIG. 8 is a top plan view of a grinding machine which, is an alternative embodiment of the present invention.

Referring now also to FIG. 8, in a grinding machine 150 many components are similar to those of the grinding machine 10. For those components of the grinding machine 150 no additional description is given here-below except as necessary to make clear the differences between the two machines, and for such components which are identical or substantially so the same reference numerals are used in FIG. 8 as in the previous views.

A principal difference between the grinding machine 150 and the grinding machine 10 is that instead of grinding wheels 32 and 34 of hard material with a durable abrasive coating as described above in connection with the grinding machine 10, the grinding machine 150 includes a pair of grinding wheels 152 and 154 in which abrasive material is distributed and held in a matrix of a softer material such as a plastic resin. During use of such wheels the surface is gradually eroded, exposing fresh, sharp-edged particles of the actual abrasive material.

Figure 9:
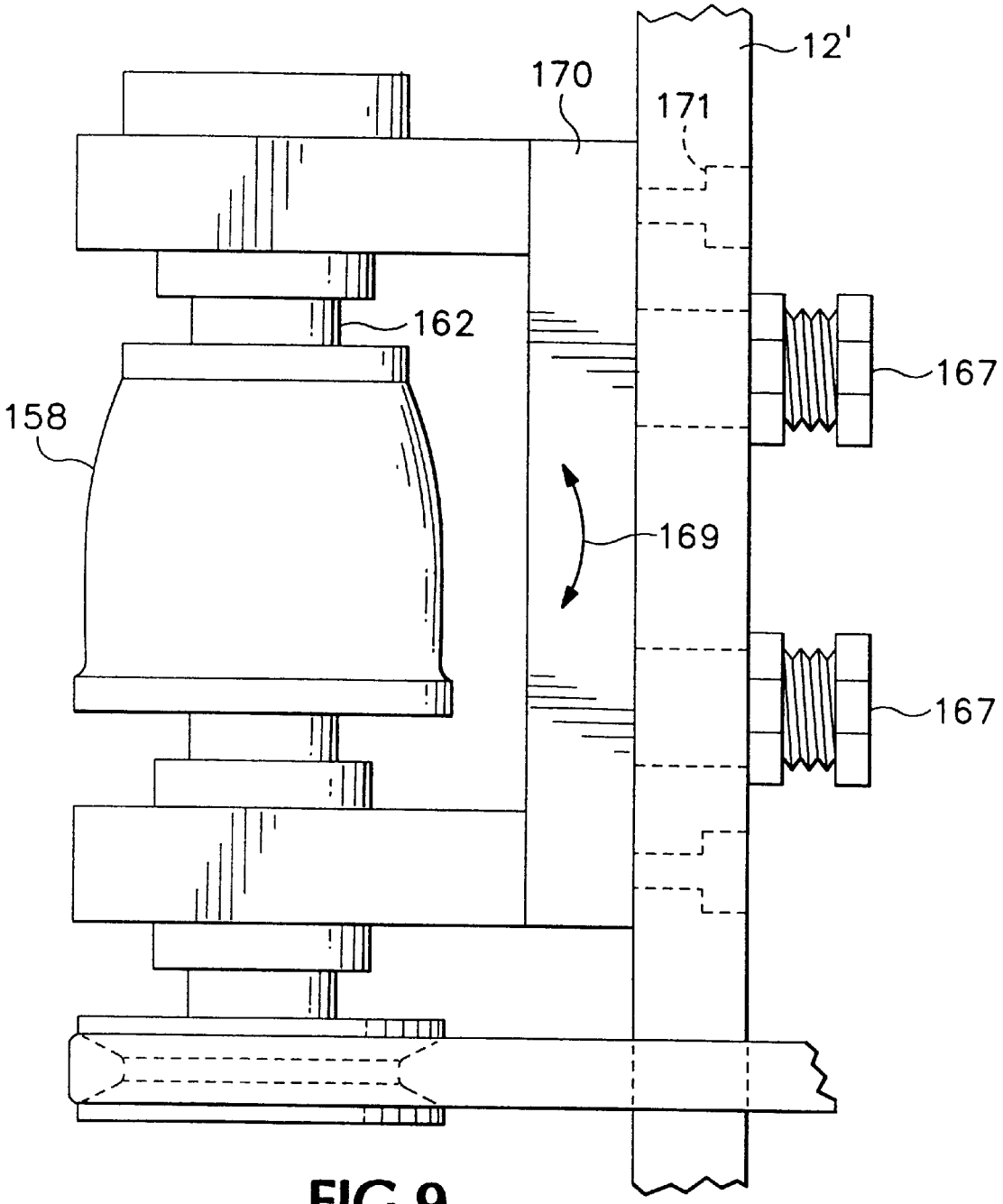
FIG. 9 is a fragmentary view taken in the direction of FIG. 8 at an enlarged scale, showing the manner of mounting one of the dressing wheels which are part of the apparatus shown in FIG. 8.

Attached to the frame 12' of the grinding machine 150 are a pair of dressing wheels or rolls 156 and 158 of construction similar to that of the grinding wheels 32 and 34, but preferably surface with diamond particles. The dressing rolls 156 and 158 have a circumferential surface shape complementary to the shape required of the grinding wheels 152 and 154 to properly grind the knife blades 66, and each grinding wheel 152 or 154 is periodically dressed by running in contact against the surface of the respective one of the dressing rolls 156 and 158. The dressing rolls 156 and 158 are supported on respective spindles 160 and 162 and are driven by motors 164 and 166. Each spindle 160 or 162 is supported rotatably on an adjustably located mounting base 168 or 170 as shown in FIG. 9. Adjustment screws 167 permit the bases 168 and 170 and the spindles 160 and 162 to be moved as indicated by arrow 169, to ensure proper alignment of the dressing wheels 156 and 158 with the grinding wheels 152 and 154 so that the surfaces of the grinding wheels 152 and 154 after being dressed are properly aligned with each other and with the position of a knife blade 66 to be ground. Mounting bolts 171 fasten the bases 168 and 170 to the frame 12' in the adjusted locations.

In the grinding machine 150, grinder motors 172 and 174 having spindles 28 and 30 are carried on two separate carriages 176 and 178, but they need not be adjustable with respect to the carriages as are the grinder motors 24 and 26 in the grinding machine 10. The grinder motors 172 and 174, however, must be operable at adjustable speeds of rotation to compensate for gradually decreasing diameter of the grinding wheels 152 and 154 during their lifetimes, in order to provide the desired linear surface speed so that the knife blades 66 can be ground efficiently. Additionally, the fixture 56 holds each blade 66 with the unsharpened edge portion 84 located in or near the imaginary plane in which the wheel centers and axes 36 and 38 of the spindles 28 and 30 travel as the carriages 176 and 178 are moved along the ways 14 and 16. The blade carrier 52 must therefore include a suitable motor, controls, and adjustable stops to pivot the fixture 56 about an axis 180, parallel to a direction position of movement of the blade carrier 52, to form each side edge bevel 108 and 110 as the angle required to produce the desired included angle 114 in the sharpened edge 112 throughout the useful lifetimes of the grinding wheels 152 and 154.

Periodically, when it is determined that either of the grinding wheels 152 and 154 is unable to grind additional knives 66 to produce side edge bevels 108 and 110 satisfactorily, the respective carriage 176 or 178 is moved to bring the grinding wheel 152, 154 into contact with the dressing wheel 156 or 158, respectively, and both are rotated by the respective motors 164 or 166 and 172 or 174 to reconfigure the surface of the grinding wheel 152 or 154.

SELF-CENTERING CLAMP

Figure 10:
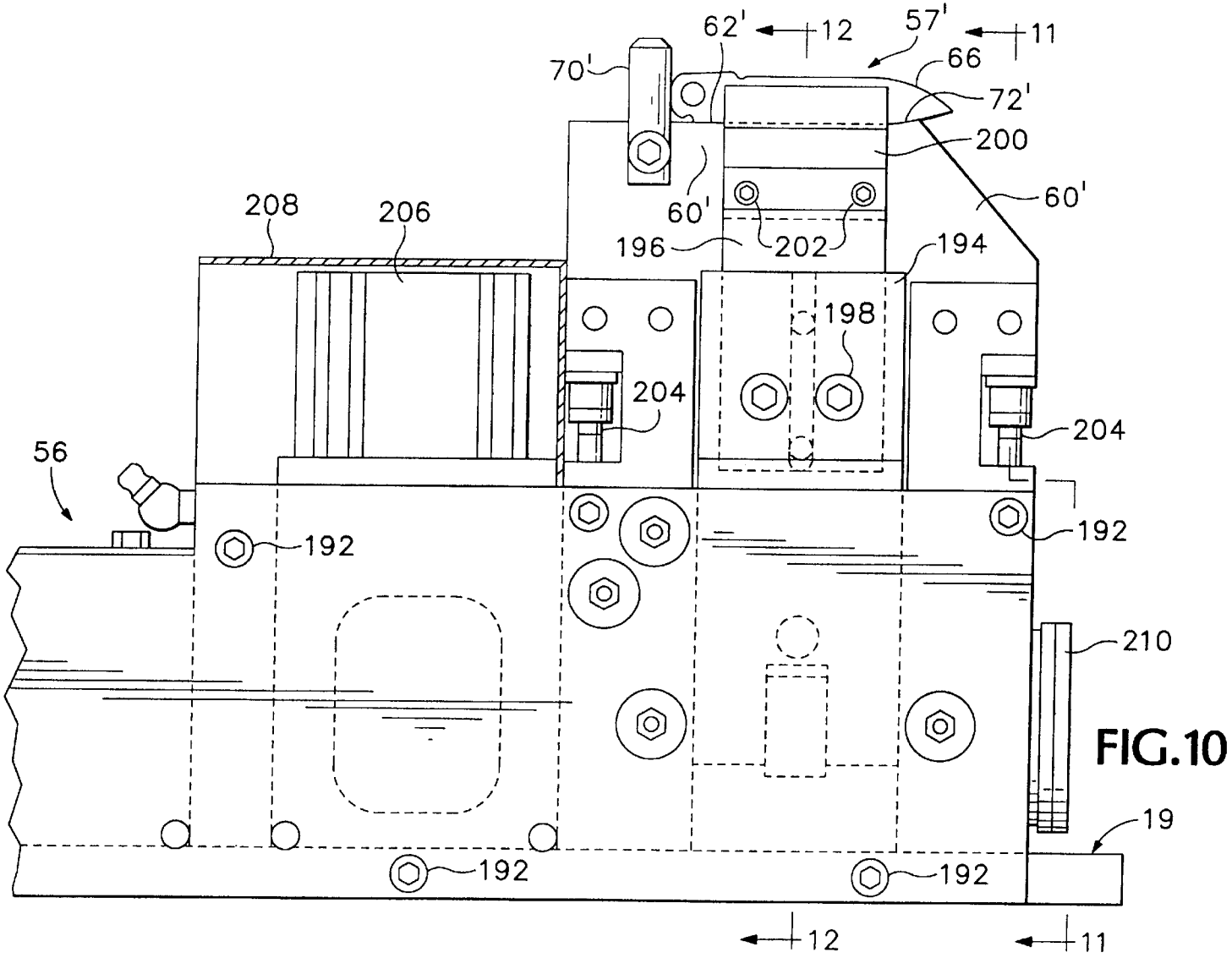
FIG. 10 is a side elevational view of an exemplary parallel clamp arrangement suitable for use as part of an apparatus embodying the present invention and suitable for use according to the method of the present invention.
Figure 11:
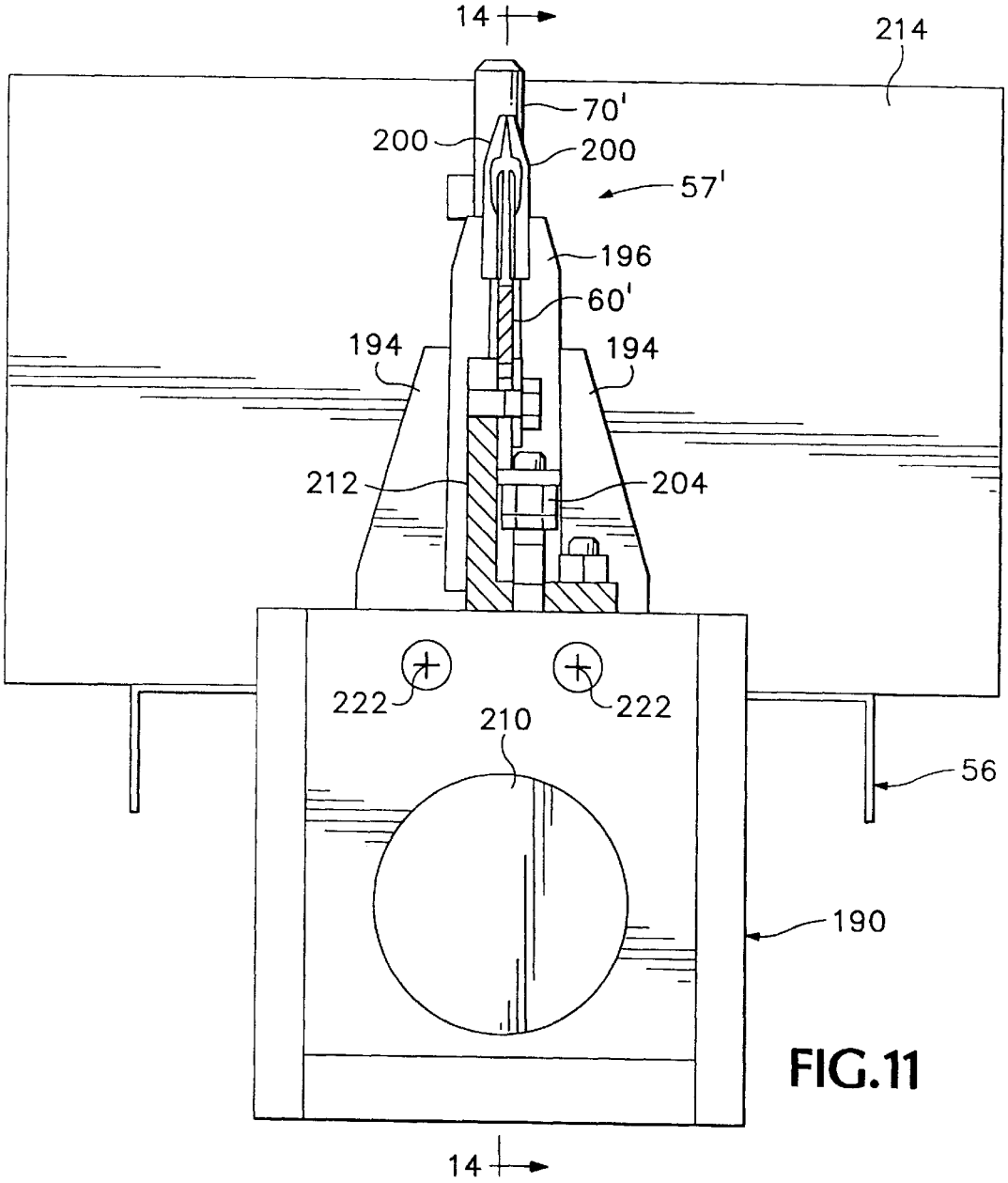
FIG. 11 is a partially sectional end view of the apparatus shown in FIG. 10, taken along line 11—11.

In FIGS. 10 and 11 a blade holding fixture 56 is shown in an embodiment including a self-centering clamp 57' including a box-like base 190 of plates assembled by the use of suitable fasteners such as bolts 192. The base 190 supports a pair of clamp arms 194 each having an upper portion 196 attached thereto adjustably by a pair of attachment bolts 198 passing through elongated holes which permit the upper arm to be moved up or down with respect to the respective clamp arm 194 so that each of the pair of opposite clamp arms can be aligned with each other so as to accommodate a knife blade 66 to be held in the clamp 57'. A respective clamp jaw 200 is securely fastened to each of the upper portions 196 of the clamp arms as by bolts 202, and a knife carrier block 60' including a back support 62' and a tip end support portion 72' are supported on the base 190 by the use of suitable fasteners and a pair of height adjustment screws 204 which can be used to place the carrier block at the correct height with respect to the clamp jaws 200. An actuator such as a cylinder and piston assembly 206 is mounted atop the base 190 and is protected by a suitable enclosure 208. A cam shaft end cover 210 is provided on the outer end of the clamp base.

The location of a portion of the carrier block 60' between the upper portions of the clamp arms and beneath the clamp jaws 200 may be seen in FIG. 11, where the support members 212 for the carrier block 60' and the manner of its attachment to the support are also shown. Behind the clamp 57' is a shield 214 to provide protection and containment for abrasive materials and metal particles resulting from grinding a knife blade 66.

Figure 13:
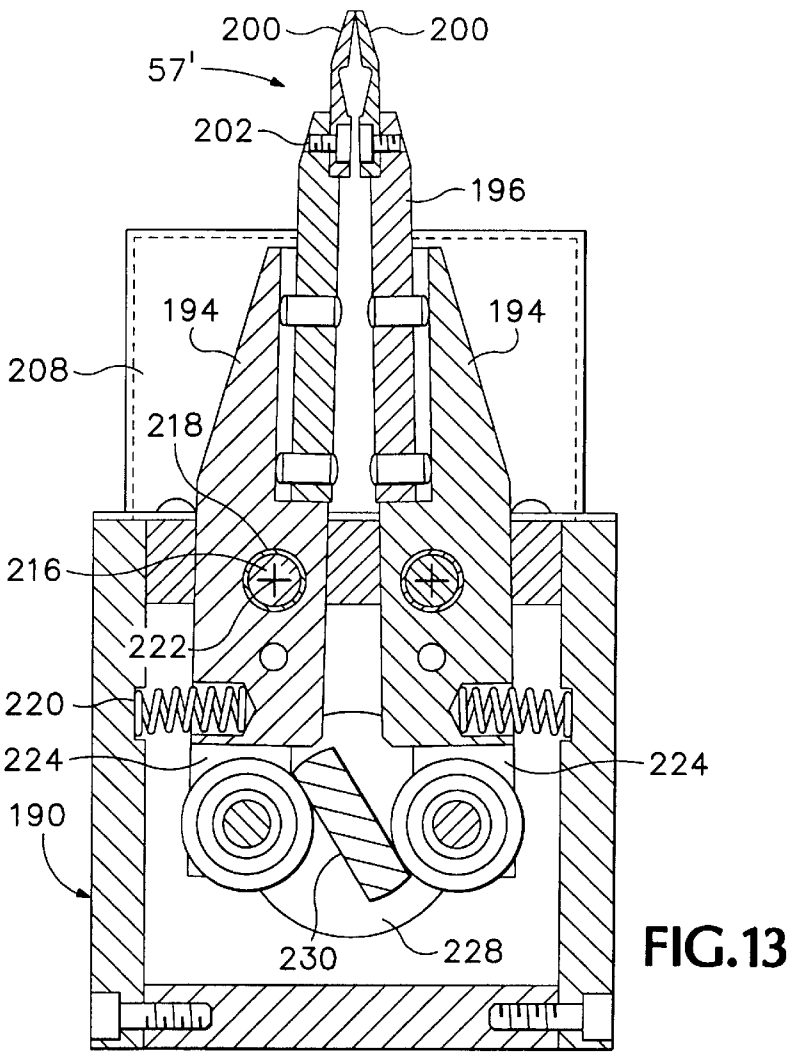
FIG. 13 is a view similar to that of FIG. 12, with the clamp jaws in the clamping position.
Figure 12:
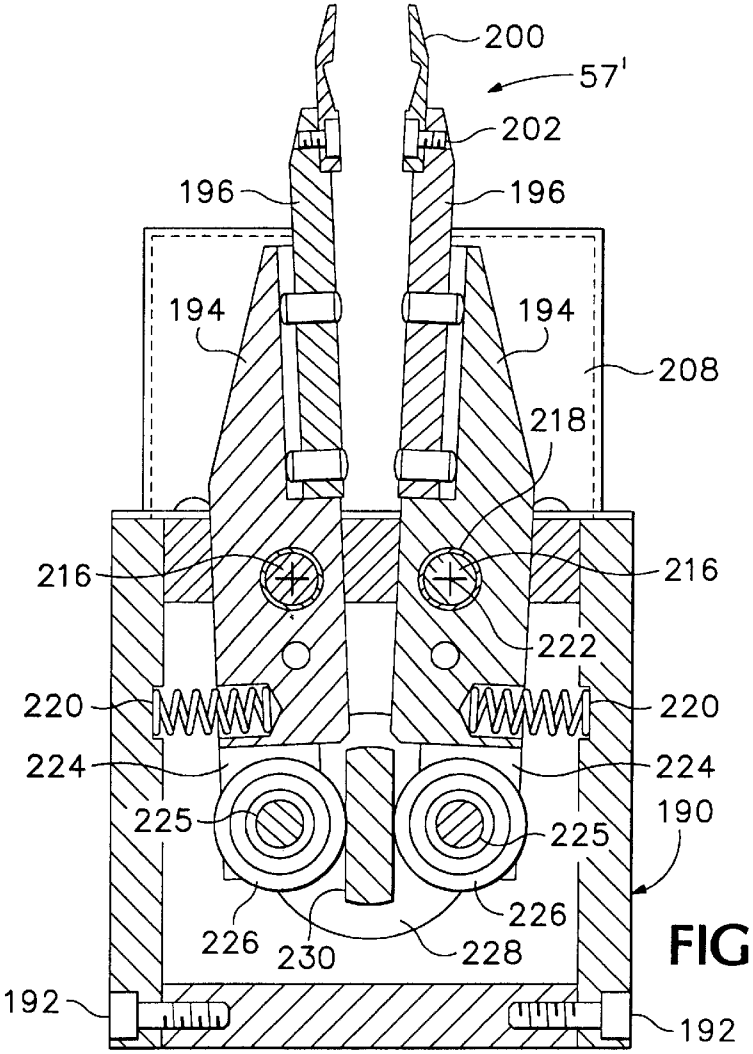
FIG. 12 is a sectional view of the clamp apparatus shown in FIG. 10, taken along line 12—12, with the clamp jaws separated to release or receive a knife blade.

The attachment of the clamp arms 194 to the clamp base 190 is shown in FIGS. 12 and 13, where respective clamp arm pivot shafts 216 and suitable bushings 218 are seen to extend parallel with each other through the clamp arms 194. Helical compression springs 220, carried in respective sockets defined in the clamp arms below the clamp arm pivot axes of rotation 222 defined by the pivot shafts, act against the inner side of the adjacent plates which are part of the clamp base 190, urging the clamp arms 194 to pivot about the shafts 216 toward an open configuration as shown in FIG. 12.

At the lower end of each clamp arm 194 is a cam follower assembly including a pair of ears 224 supporting a cam follower shaft 225 on which is carried a suitable roller bearing 226 which is the actual cam follower. Preferably the shafts 225 of the two clamp arms 194 are spaced apart from the clamp arm pivot shafts 216 by equal distances, and a cam shaft 228 whose axis of rotation is located centrally between the cam follower shafts 225 includes a cam 230 which as shown has a pair of parallel flat cam surfaces, so that when the cam shaft 228 is rotated from its position as shown in FIG. 12 the cam 230 pushes against each cam follower 226 urging the lower ends of the clamp arms 194 apart from each other and thus moving the clamp jaws 200 toward each other and the position shown in FIG. 13.

Figure 14:
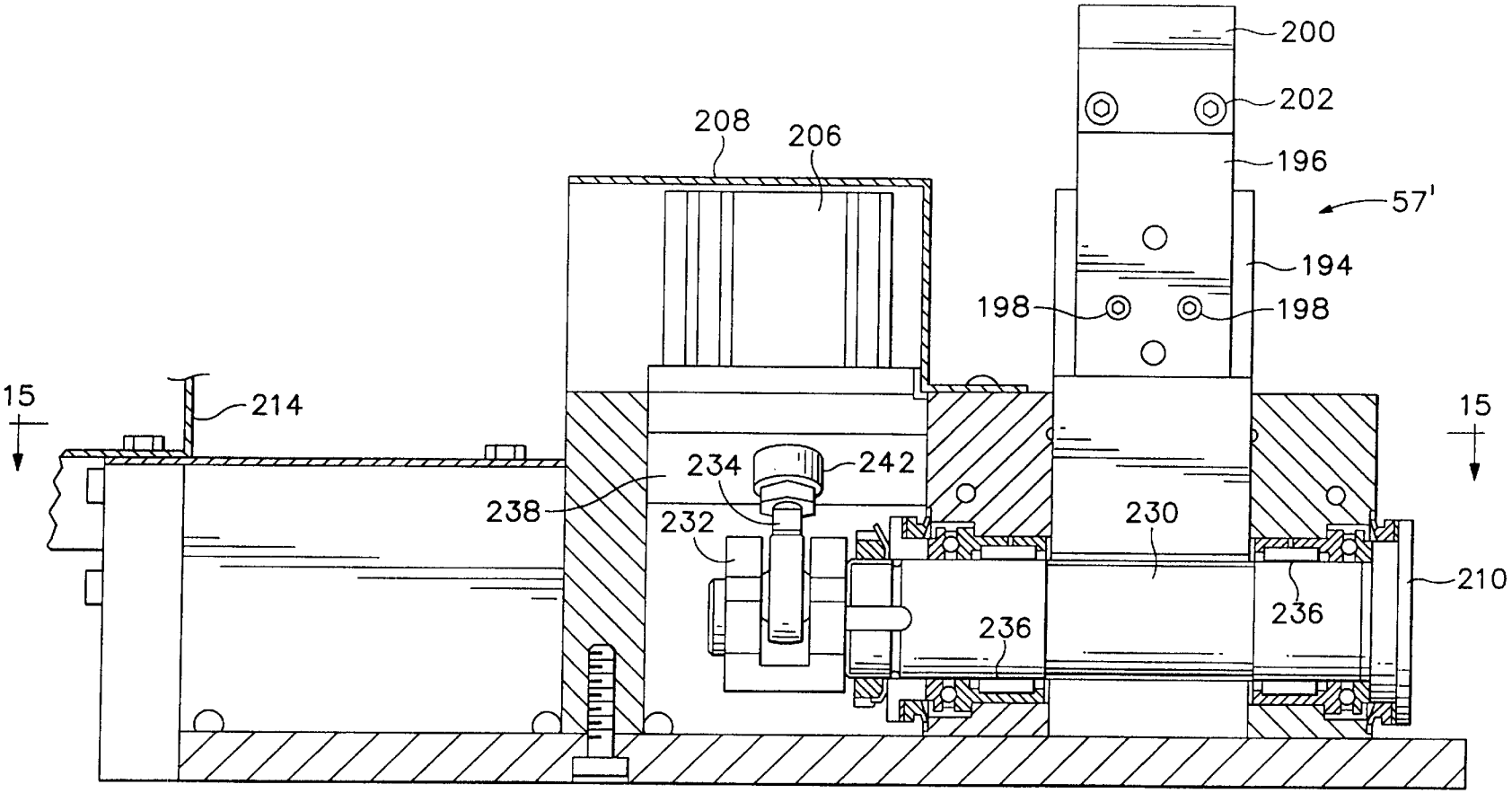
FIG. 14 is a sectional view of the clamp mechanism shown in FIGS. 10–13, taken along line 14—14 of FIG. 11.
Figure 15:
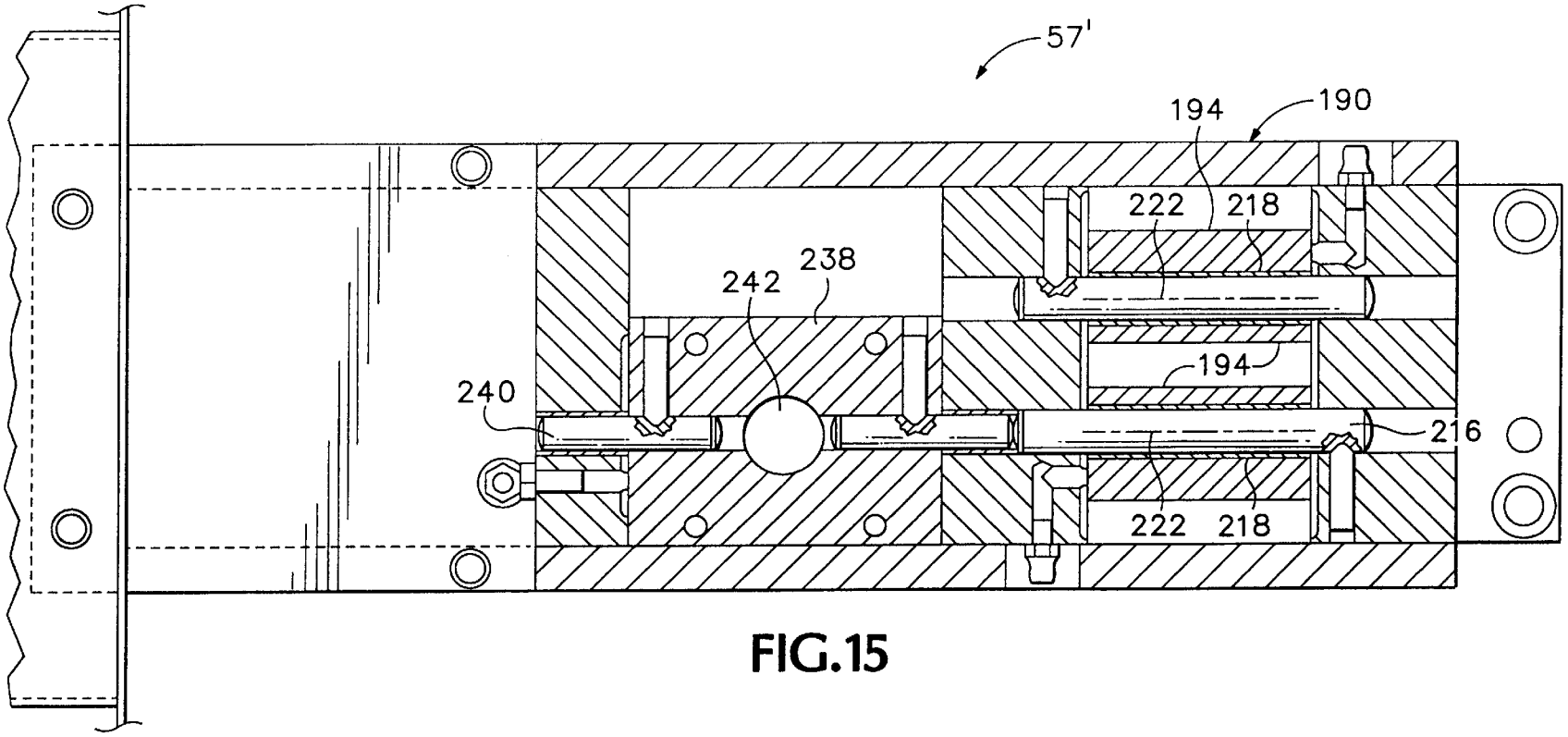
FIG. 15 is a sectional view of the apparatus shown in FIGS. 11–14, taken along line 15—15 of FIG. 14.

As may be seen in FIG. 14, the cam shaft 228 is rotated by a crank arm 232 driven through a small angle of rotation of the cam shaft 228 by the actuator 206, acting through a connecting rod 234 attached suitably to the crank arm 232. The cam shaft is carried in suitable bearings 236 in order to be able to withstand many cycles of opening and closing of the clamp jaws. As may be understood by reference to FIG. 15, the actuator 206 is carried on a block 238 which is free to pivot about an axis 240 defined by a pair of pivot shafts between which a passageway 242 is defined for the actuator connecting rod to extend through the block 238. Also shown in FIG. 15 are the shafts for the clamp arms, which define parallel clamp arm axes of rotation 222 of the clamp arms, as mentioned previously.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method of sharpening a knife blade having a thickness tapered between a greatest thickness near a back of the blade and a minimum thickness near an edge portion, the method comprising:

(a) supporting the back of the blade on a fixture;

(b) moving a pair of parallel clamp jaws toward each other into clamping contact against a pair of opposite side faces of the blade at respective locations between the back and the edge portion to clamp the blade in a first position with respect to the fixture;

(c) thereafter, while keeping the blade clamped in said first position, moving a first abrasive wheel in a first direction and thereby bringing a surface of said abrasive wheel into contact with a first side of said edge portion;

(d) continuing to move said first abrasive wheel a predetermined distance farther in said first direction, forming a first ground edge side bevel;

(e) thereafter keeping said blade clamped in said first position and moving a second abrasive wheel in a second direction bringing a surface of said second abrasive wheel into contact with an opposite second side of said edge portion; and (f) continuing to move said second abrasive wheel a predetermined distance farther in said second direction, thereby forming a second ground edge side in substantial symmetry with said first ground edge side bevel and defining a sharp edge between said first and second side ground edge bevels.

2. The method of claim 1 wherein said step of supporting the back of the blade includes supporting a rear end of the blade in a predetermined position with respect to said fixture in a direction extending longitudinally of said blade.

3. A method of grinding a knife blade having a tapered thickness and a pair of opposite tapered sides extending between a back and an edge portion, the method comprising:

(a) gripping said tapered part of said blade between a pair of clamping faces located equidistant from a reference plane defined by a blade-holding fixture;

(b) grinding a first side of said knife blade along said edge portion by holding said knife blade in contact with a first rotating grinding wheel having a predetermined profile; and (c) thereafter continuing to hold said blade immobile in said fixture and grinding the other one of said tapered sides with a second rotating grinding wheel having a predetermined profile.

4. A method of grinding a knife blade to produce a sharp edge, comprising:

(a) providing a tapered knife blade having a pair of opposite sides defining a centrally-located narrow margin;

(b) inserting said knife blade in a blade holding fixture between a pair of opposite clamping faces and moving said opposite clamping faces toward each other and into contact against said opposite sides of said blade, thereby engaging and tightly holding said knife blade in said blade holding fixture;

(c) while holding said knife blade in said fixture, grinding a first side of said knife blade along said narrow margin by moving a first rotating grinding wheel having a predetermined profile into contact with said knife blade; and (d) thereafter continuing to hold said blade immobile in said fixture and grinding the other one of said tapered sides along said narrow margin by moving a second rotating abrasive wheel having a predetermined profile into contact therewith.

5. The method of claim 4, including the step of rotating one of said grinding wheels about an axis oriented normal to an axis of rotation of said grinding wheel and located in a plane parallel with a plane including said narrow margin.

6. A knife-grinding apparatus, comprising:

(a) a frame;

(b) a set of ways supported by said frame;

(c) a grinder carriage, movable along said ways and guided thereby;

(d) a grinder mounted on said carriage, said grinder including a respective spindle having a spindle axis, and said grinder being arranged to rotate said spindle about its axis;

(e) a blade-holding fixture supported in a predetermined position with respect to said frame and including a registration surface and a clamp having a pair of clamp jaws of which at least one is movable controllably toward the other so as to bring said jaws respectively into clamping contact against opposite sides of a knife blade;

(f) a motor, interconnected with said carriage and said frame through a drive mechanism arranged to move said carriage controllably along said ways; and (g) a respective profiled abrasive wheel mounted on said spindle for rotation therewith, said abrasive wheel being of a predetermined size and shape and having an abrasive outer surface.

7. The apparatus of claim 6, said spindle axis defining a reference plane as said carriage moves along said ways, and the apparatus including a grinder mounting assembly interconnecting said grinder to said carriage and providing for adjustment of the position of said spindle axis of the respective spindle through an angle of adjustment about an adjustment axis oriented substantially normal to said reference plane.

8. The apparatus of claim 7 wherein said grinder mounting assembly includes a pair of parallel support members, of which a first one is attached fixedly to said carriage and a second one is attached thereto by a center post and is adjustably movable through a limited angle about said adjustment axis.

9. The apparatus of claim 8, including a pair of opposed adjustment screws associated with said first parallel support member and arranged to move said other one with respect thereto.

10. The apparatus of claim 9 wherein each of said jaws of said clamp has a clamping face shaped to rest firmly in contact against one of a pair of opposite sides of a tapered knife blade.

11. The apparatus of claim 6 wherein said profiled abrasive wheel is of as hard material and has a coating of a durable abrasive material defining a peripheral surface profile designed to grind a knife blade blank to a predetermined shape.

12. The apparatus of claim 6 wherein said clamp of said blade-holding fixture is a self-centering clamp having a pair of opposing jaws which both move toward a predetermined position with respect to a part of said fixture.

13. The apparatus of claim 6 wherein said blade-holding fixture includes a blade support establishing a reference location for a knife blade having a predetermined shape and size.

* * * * *

UNITED STATES PATENT AND TRADEMARK OFFICE

CERTIFICATE OF CORRECTION

PATENT NO. : 5,906,534
DATED : May 25, 1999
INVENTOR(S) : Christopher V. Folkman et al.

It is certified that error appears in the above-identified patent and that said Letters Patent is hereby corrected as shown below:

Column 3,
Line 7, delete "6*e*" and insert -- 6 -- in place thereof.
Line 8, delete the comma following the word "which".

Column 12,
Line 24, delete "as" and insert -- a -- in place thereof.

Signed and Sealed this

Fourth Day of December, 2001

*Attest:*

Nicholas P. Godici

*Attesting Officer*

NICHOLAS P. GODICI
*Acting Director of the United States Patent and Trademark Office*